US012618184B2

(12) United States Patent
Chung et al.

(10) Patent No.: US 12,618,184 B2
(45) Date of Patent: May 5, 2026

(54) SYSTEMS AND METHODS USING IMAGE RECOGNITION PROCESSES FOR IMPROVED OPERATION OF A LAUNDRY APPLIANCE

(71) Applicant: Haier US Appliance Solutions, Inc., Wilmington, DE (US)

(72) Inventors: MyungGeon Chung, Seoul (KR); Hyeonsoo Moon, Seoul (KR); Je Kwon Yoon, San Jose, CA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 338 days.

(21) Appl. No.: 18/457,810

(22) Filed: Aug. 29, 2023

(65) Prior Publication Data

US 2025/0075389 A1 Mar. 6, 2025

(51) Int. Cl.

| | |
|---|---|
| ***D06F 34/18*** | (2020.01) |
| ***D06F 33/37*** | (2020.01) |
| ***D06F 34/05*** | (2020.01) |
| *D06F 33/34* | (2020.01) |
| *D06F 103/04* | (2020.01) |

(52) U.S. Cl.

CPC ..... *D06F 34/18* (2020.02); *D06F 33/37* (2020.02); *D06F 34/05* (2020.02); *D06F 33/34* (2020.02); *D06F 2103/04* (2020.02)

(58) Field of Classification Search

CPC ..... D06F 33/37; D06F 34/05; D06F 34/18; D06F 33/34

See application file for complete search history.

(56) References Cited

U.S. PATENT DOCUMENTS

| | | | | |
|---|---|---|---|---|
| 9,014,826 | B2 | 4/2015 | Yum et al. | |
| 9,798,946 | B2 | 10/2017 | Lee et al. | |
| 10,104,282 | B2 | 10/2018 | Graham et al. | |
| 10,612,175 | B2 | 4/2020 | Hombroek | |
| 11,124,916 | B2 | 9/2021 | Ashrafzadeh et al. | |
| 11,512,419 | B2 * | 11/2022 | Kim | D06F 39/00 |
| 2008/0276964 | A1 * | 11/2008 | Hendrickson | D06F 33/37 68/12.03 |
| 2019/0276973 | A1 | 9/2019 | Homebroek | |

(Continued)

FOREIGN PATENT DOCUMENTS

| | | | |
|---|---|---|---|
| CN | 109610132 | A | 4/2019 |
| EP | 3751454 | A1 | 12/2020 |

(Continued)

*Primary Examiner* — Michael E Barr
*Assistant Examiner* — Kevin G Lee
(74) *Attorney, Agent, or Firm* — Dority & Manning, P.A.

(57) ABSTRACT

A method of operating a washing machine appliance includes obtaining an image of the wash basket and a load of articles therein from a camera assembly of a remote user interface device. The method also includes analyzing the obtained image using a machine learning image recognition process. Analyzing the obtained image may include determining a ratio of a diameter of an area occupied by the load of articles to a diameter of the wash basket or determining a ratio of a maximum height of an area occupied by the load of articles to a major axis of the wash basket. The method further includes estimating a load size of the load of articles based on the analysis and directing a wash cycle within the washing machine appliance based on the estimated load size.

19 Claims, 7 Drawing Sheets

(56) References Cited

U.S. PATENT DOCUMENTS

| | | | | |
|---|---|---|---|---|
| 2019/0284743 | A1 | 9/2019 | Hwang et al. | |
| 2020/0392660 | A1 | 12/2020 | Park | |
| 2021/0142110 | A1* | 5/2021 | Tian | G06N 3/09 |
| 2021/0246593 | A1* | 8/2021 | Leitert | D06F 33/00 |

FOREIGN PATENT DOCUMENTS

| | | | |
|---|---|---|---|
| KR | 101832762 | B1 | 2/2018 |
| WO | WO2020215777 | A1 | 10/2020 |

* cited by examiner

SYSTEMS AND METHODS USING IMAGE RECOGNITION PROCESSES FOR IMPROVED OPERATION OF A LAUNDRY APPLIANCE

FIELD OF THE INVENTION

The present subject matter relates generally to washing machine appliances, or more specifically, to systems and methods for using image recognition processes to improve or optimize operation of washing machine appliances.

BACKGROUND OF THE INVENTION

Washing machine appliances generally include a tub for containing water or wash fluid, e.g., water and detergent, bleach, or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Notably, it is frequently desirable to understand characteristics of a load of articles, e.g., clothes, within the washing machine appliance, e.g., in order to optimize water usage, agitation time, agitation profile selection, and other wash parameters. For example, certain loads (e.g., towels or linens) may require more water and detergent, increased water temperature, and stronger agitation cycles. By contrast, other loads (e.g., such mixed color loads or delicates) may require cooler water and a gentler agitation profile. However, conventional washing machine appliances require a user to select operating cycles or specify the type of load added to the wash chamber, often resulting in inaccurate inputs or sub-optimal cycle settings. Attempts have been made to automatically (e.g., without direct user input or estimations) detect certain attributes of a load using sensors or detection assemblies within the washing machine appliance. Unfortunately, though, such systems may increase the expense and complexity of an appliance. Moreover, it can be difficult for a user to know if or when any detected attributes have been detected accurately or correctly.

Accordingly, a washing machine appliance with features for improved wash performance would be desirable. More specifically, a system and method for automatically detecting characteristics of the load of articles and determining preferred operating parameters would be particularly beneficial, especially if such systems or methods could be achieved without requiring additional or dedicated sensing assemblies to be installed on the washing machine appliance. Additionally or alternatively, it may be beneficial to provide a system or method wherein a user could be confident that characteristics were detected in the correct manner (e.g., to ensure accuracy of such detections).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The washing machine appliance defines a vertical direction, a lateral direction, and a transverse direction. The vertical direction, the lateral direction, and the transverse direction are mutually perpendicular. The washing machine appliance includes a cabinet, a wash tub mounted within the cabinet, and a wash basket. The wash basket defines a wash chamber. The wash basket is rotatably mounted within the wash tub whereby the wash basket is rotatable about the vertical direction. The method includes obtaining one or more images of the wash basket and a load of articles therein from a camera assembly of a remote user interface device. The method also includes analyzing at least one obtained image using a machine learning image recognition process. Analyzing the at least one obtained image includes determining a ratio of a diameter of an area occupied by the load of articles to a diameter of the wash basket. The method further includes estimating a load size of the load of articles based on the analysis and directing a wash cycle within the washing machine appliance based on the estimated load size.

In another exemplary aspect of the present disclosure, a method of operating a washing machine appliance is provided. The washing machine appliance defines a vertical direction, a lateral direction, and a transverse direction. The vertical direction, the lateral direction, and the transverse direction are mutually perpendicular. The washing machine appliance includes a cabinet, a wash tub mounted within the cabinet, and a wash basket. The wash basket defines a wash chamber. The wash basket is rotatably mounted within the wash tub whereby the wash basket is rotatable about the vertical direction. The method includes obtaining one or more images of the wash basket and a load of articles therein from a camera assembly of a remote user interface device. The method also includes analyzing at least one obtained image using a machine learning image recognition process. Analyzing the at least one obtained image includes determining a ratio of a maximum height of an area occupied by the load of articles to a major axis of the wash basket. The method further includes estimating a load size of the load of articles based on the analysis and directing a wash cycle within the washing machine appliance based on the estimated load size.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
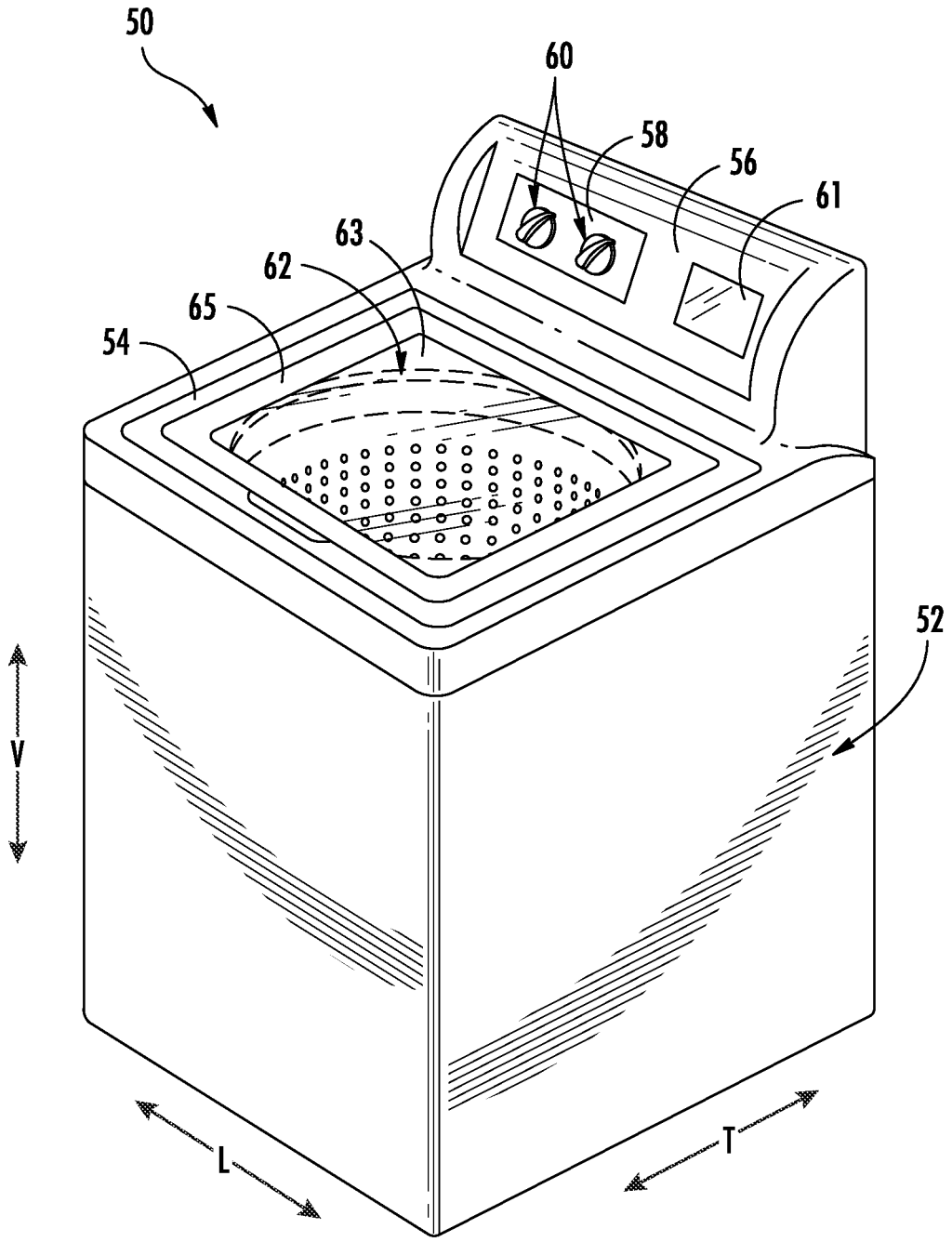
FIG. 1 provides a perspective view of an exemplary washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "clothing," "articles," and the like may include but need not be limited to fabrics, textiles, garments, linens, papers, or other items which may be cleaned, dried, and/or otherwise treated in a laundry appliance. Furthermore, the terms "load" or "laundry load" refers to the combination of clothing that may be washed together in a washing machine or dried together in a dryer appliance and may include a mixture of different or similar articles of clothing of different or similar types and kinds of fabrics, textiles, garments and linens within a particular laundering process.

Figure 2:
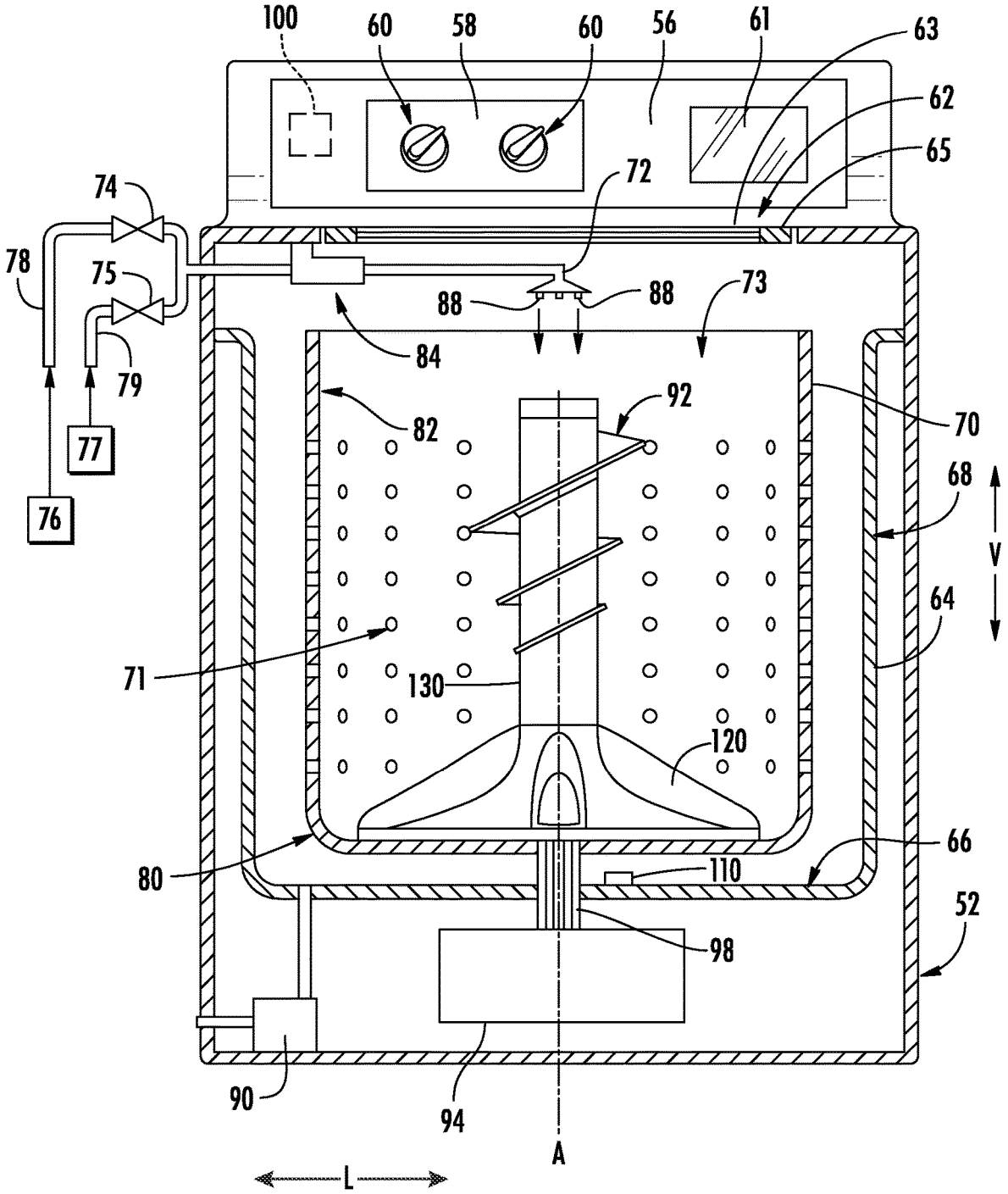
FIG. 2 provides a side cross-sectional view of the exemplary washing machine appliance of FIG. 1.

Turning now to the figures, FIGS. 1 and 2 provide views of a washing machine appliance 50 according to one or more example embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system. Washing machine appliance 50 may include a cabinet 52 and a cover 54. A backsplash 56 extends from cover 54, and a control panel 58, including a plurality of input selectors 60, is coupled to backsplash 56.

As used herein, the terms "cabinet," "housing," and the like are generally intended to refer to an outer frame or support structure for washing machine appliance 50, e.g., including any suitable number, type, and configuration of support structures formed from any suitable materials, such as a system of elongated support members, a plurality of interconnected panels, or some combination thereof. It should be appreciated that cabinet 52 does not necessarily require an enclosure and may simply include open structure supporting various elements of washing machine appliance 50. By contrast, cabinet 52 may enclose some or all portions of an interior of cabinet 52. It should be appreciated that cabinet 52 may have any suitable size, shape, and configuration while remaining within the scope of the present subject matter.

Control panel 58 and input selectors 60 collectively form a user interface input for operator selection of machine cycles and features, and in one example embodiment, a display 61 may indicate selected features, a countdown timer, or other items of interest to machine users. It should be appreciated, however, that in other example embodiments, the control panel 58, input selectors 60, and display 61, may have any other suitable configuration. For example, in other example embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in the illustrated example embodiment includes a transparent panel 63, which may be formed of, for example, glass, plastic, or any other suitable material. The transparency of the panel 63 allows users to see through the panel 63, and into the tub 64 when the lid 62 is in the closed position. In some example embodiments, the panel 63 itself can generally form the lid 62. In other example embodiments, the lid 62 includes the panel 63 and a frame 65 surrounding and encasing the panel 63. Alternatively, panel 63 need not be transparent, e.g., the panel 63 may be translucent or opaque.

As may be seen in FIG. 2, tub 64 includes a bottom wall 66 and a sidewall 68. A wash drum or basket 70 is rotatably mounted within tub 64. In particular, basket 70 is rotatable about a central axis, which may, when properly balanced and positioned, e.g., as in the example embodiment illustrated, be a vertical axis that is parallel to or generally parallel to the vertical direction V. Thus, washing machine appliance is generally referred to as a vertical axis washing machine appliance or a top load washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g., water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the wash chamber of washing machine appliance 50. For the example embodiment depicted, the flow regulator includes a hot water valve 74 and a cold water valve 75. The hot and cold water valves 74, 75 are used to flow hot water and cold water, respectively, therethrough. Each valve 74, 75 can selectively adjust between a closed position to terminate or obstruct the flow of fluid therethrough to nozzle 72 and an open position to permit the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial or municipal water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the example embodiment depicted, nozzle 72 is a separate downstream component from dispenser 84. In other example embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other example embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity-assisted flow to drain tub 64.

An agitation element 92 may be oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional example embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a temperature sensor 110 may be positioned in the tub 64 as illustrated or, alternatively, may be remotely mounted in another location within the appliance 50. Any suitable temperature sensor 110 may be used as the first temperature sensor 110. The temperature sensor 110 may generally measure the temperature of contents of the tub 64, such as wash liquid in the tub 64. Additionally, a suitable speed sensor can be connected to the motor 94, such as to the output shaft 98 thereof, to measure speed and indicate operation of the motor 94. Other suitable sensors, such as pressure sensors, water sensors, moisture sensors, etc., may additionally be provided in the washing machine appliance 50. As used herein, "temperature sensor" or the equivalent is intended to refer to any suitable type of temperature measuring system or device positioned at any suitable location for measuring the desired temperature. Thus, for example, temperature sensor 110 may be any suitable type of temperature sensor, such as a thermistor, a thermocouple, a resistance temperature detector, a semiconductor-based integrated circuit temperature sensors, etc., such as may each be the same type of temperature sensor or may be differing types of temperature sensor. In addition, temperature sensor 110 may be positioned at any suitable location and may output a signal, such as a voltage, to a controller that is proportional to and/or indicative of the temperature being measured. Although exemplary positioning of temperature sensors is described herein, it should be appreciated that washing machine appliance 50 may include any other suitable number, type, and position of temperature, humidity, and/or other sensors according to alternative embodiments.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, first temperature sensor 110, other suitable sensors, etc. In response to user manipulation of the input selectors 60, controller 100 may operate the various components of washing machine appliance 50 to execute selected machine cycles and features. In this regard, control panel 58, user input devices 60, and display 61 may be in communication with controller 100 such that controller 100 may receive control inputs from user input devices 60, may display information using display 61, and may otherwise regulate operation of appliance 50. For example, signals generated by controller 100 may operate appliance 50, including any or all system components, subsystems, or interconnected devices, in response to the position of user input devices 60 and other control commands. Control panel 58 and other components of appliance 50 may be in communication with controller 100 via, for example, one or more signal lines or shared communication busses. In this manner, Input/Output ("I/O") signals may be routed between controller 100 and various operational components of appliance 50.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 100 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 100 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 100 may be operable to execute programming instructions or micro-control code associated with an operating cycle of appliance 50. In this regard, the instructions may be software or any set of instructions that when executed by the processing device, cause the processing device to perform operations, such as running one or more software applications, displaying a user interface, receiving user input, processing user input, etc. Moreover, it should be noted that controller 100 as disclosed herein is capable of and may be operable to perform any methods, method steps, or portions of methods as disclosed herein. For example, in some embodiments, methods disclosed herein may be embodied in programming instructions stored in the memory and executed by controller 100.

The memory devices may also store data that can be retrieved, manipulated, created, or stored by the one or more processors or portions of controller 100. The data can include, for instance, data to facilitate performance of methods described herein. The data can be stored locally (e.g., on controller 100) in one or more databases and/or may be split up so that the data is stored in multiple locations. In addition, or alternatively, the one or more database(s) can be connected to controller 100 through any suitable network(s), such as through a high bandwidth local area network (LAN) or wide area network (WAN). In this regard, for example, controller 100 may further include a communication module or interface that may be used to communicate with one or more other component(s) of appliance 50, controller 100, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 3:
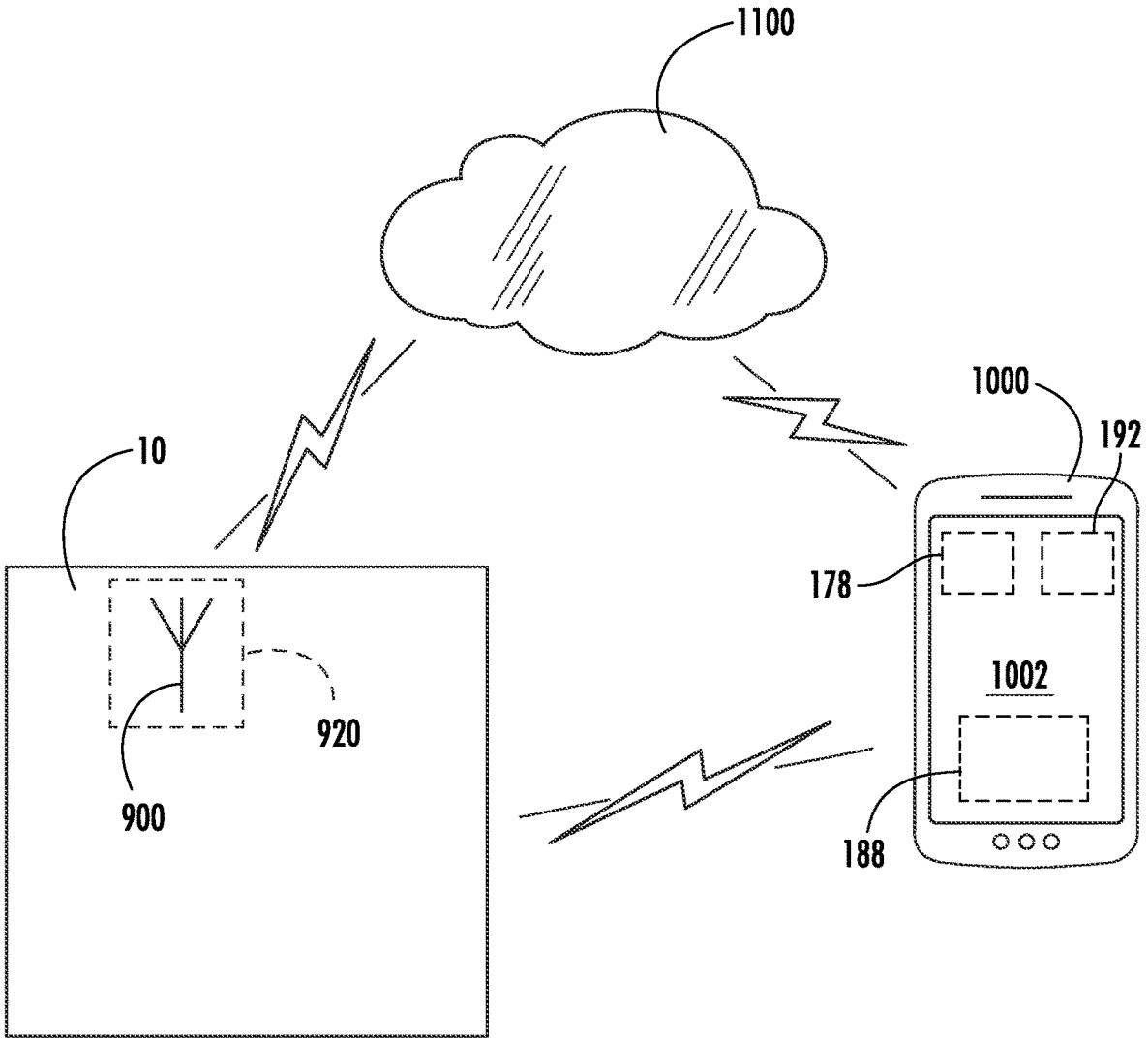
FIG. 3 provides a diagrammatic illustration of a washing machine appliance in communication with a remote computing device and with a remote user interface device according to one or more exemplary embodiments of the present subject matter.

Turning now to FIG. 3, a general schematic is provided of a washing machine appliance 10, such as but not limited to washing machine appliance 50 described above, which communicates wirelessly with a remote user interface device 1000 and a network 1100. For example, as illustrated in FIG. 3, the washing machine appliance 10 may include an antenna 900 by which the washing machine appliance 10 communicates with, e.g., sends and receives signals to and from, the remote user interface device 1000 and/or network 1100. The antenna 900 may be part of, e.g., onboard, a communications module 920. The communications module 920 may be a wireless communications module operable to connect wirelessly, e.g., over the air, to one or more other devices via any suitable wireless communication protocol. For example, the communications module 920 may be a WI-FI® module, a BLUETOOTH® module, or a combination module providing both WI-FI® and BLUETOOTH® connectivity. The remote user interface device 1000 may be a laptop computer, smartphone, tablet, personal computer, wearable device, smart speaker, smart home system, and/or various other suitable devices. The communications module 920 may be onboard the controller 100 or may be a separate module.

The communications module 920 may be configured for permitting interaction, data transfer, and other communications between washing machine appliance 10 and one or more remote external devices. For example, this communication may be used to provide and receive operating parameters, user instructions or notifications, performance characteristics, user preferences, or any other suitable information for improved performance of washing machine appliance 10. In addition, it should be appreciated that communications module 920 may be used to transfer data or other information to improve performance of one or more external devices or appliances or improve user interaction with such devices.

The washing machine appliance 10 may be in communication with the remote user interface device 1000 device through various possible communication connections and interfaces. The washing machine appliance 10 and the remote user interface device 1000 may be matched in wireless communication, e.g., connected to the same wireless network. The washing machine appliance 10 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the washing machine appliance 10 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not structurally connected to the washing machine appliance 10, e.g., the remote user interface device 1000 is a separate, stand-alone device from the washing machine appliance 10 which communicates with the washing machine appliance 10 wirelessly. Any suitable device separate from the washing machine appliance 10 that is configured to provide and/or receive communications, information, data, or commands from a user may serve as the remote user interface device 1000, such as a smartphone (e.g., as illustrated in FIG. 3), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface panel 180. For example, the remote user interface device 1000 may be a smartphone operable to store and run applications, also known as "apps," and the additional user interface may be provided as a smartphone app.

As mentioned above, the washing machine appliance 10 may also be configured to communicate wirelessly with a network 1100. The network 1100 may be, e.g., a cloud-based data storage system including one or more remote computing devices such as remote databases and/or remote servers, which may be collectively referred to as "the cloud." The network 1100 may include, e.g., one or more remote computing devices, such as a remote database, remote server, etc., in a distributed computing environment. Such distributed computing environments may include, for example, cloud computing, fog computing, and/or edge computing. For example, the washing machine appliance 10 may communicate with the network 1100 over the Internet, which the washing machine appliance 10 may access via WI-FI®, such as from a WI-FI® access point in a user's home, or in a laundromat or dormitory, etc.

The remote user interface device 1000 may be configured to capture and/or display images. For example, the remote user interface device 1000 may be a smartphone, e.g., as illustrated in FIG. 3, which includes both a camera (not shown) for capturing images and a display 1002, e.g., a touchscreen or other screen, for displaying images.

In some embodiments, remote user interface device 1000 may include a camera or camera module 178. Camera 178 may be any type of device suitable for capturing a two-dimensional picture or image. As an example, camera 178 may be a video camera or a digital camera with an electronic image sensor [e.g., a charge coupled device (CCD) or a CMOS sensor]. When assembled, camera 178 is generally mounted or fixed to a body of remote user interface device 1000 and is in communication (e.g., electric or wireless communication) with a controller of the remote user interface device 1000 such that the controller may receive a signal from camera 178 corresponding to the image captured by camera 178.

Generally, remote user interface device 1000 may include a controller 188 (e.g., including one or more suitable processing devices, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. Controller 188 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor of controller 188 or may be included onboard within such processor. In addition, these memory devices can store information or data accessible by the one or more processors of the controller 188, including instructions that can be executed by the one or more processors. It should be appreciated that the instructions can be software written in any suitable programming language or can be implemented in hardware. Additionally, or alternatively, the instructions can be executed logically or virtually using separate threads on one or more processors.

For example, controller 188 may be operable to execute programming instructions or micro-control code associated with operation of or engagement with washing machine appliance 10. In this regard, the instructions may be software or any set of instructions that when executed by the processing device, cause the processing device to perform operations, such as running one or more software applications, displaying, or directing a user interface, receiving user input, processing user input, etc. Moreover, it should be noted that controller 188 as disclosed herein is capable of and may be operable to perform one or more methods, method steps, or portions of methods of appliance operation.

For example, in some embodiments, these methods may be embodied in programming instructions stored in the memory and executed by controller 188.

The memory devices of controller 188 may also store data that can be retrieved, manipulated, created, or stored by the one or more processors or portions of controller 188. The data can include, for instance, data to facilitate performance of methods described herein. In some embodiments, controller 188 may be configured to direct a presentation or display of a real-time feed from the camera 178 (e.g., on display 1002). Optionally, a reticle, e.g., a two-dimensional reference shape, for alignment of the remote user interface device 1000 may be displayed. Moreover, movement guidance (e.g., in the form of pictorial or textual instructions, such as arrows or written messages, such as the written messages 214 in FIGS. 4 and 6) may be displayed such that a user can properly align the camera 178 to capture an image that may be further analyzed (e.g., to estimate one or more load attributes of a load of articles within the wash chamber 73).

In certain embodiments, a measurement device 192 may be included with or connected to controller 188 on remote user interface device 1000. Moreover, measurement devices 192 may include a microprocessor that performs the calculations specific to the measurement of position or movement with the calculation results being used by controller 188. Generally, measurement device 192 may detect a plurality of angle readings. For instance, multiple angle readings may be detected simultaneously to track multiple (e.g., mutually orthogonal) axes of the remote user interface device 1000. For instance, the axes may be detected or tracked relative to gravity and, thus, the installed washing machine appliance 10. Optionally, a measurement device 192 may be or include an accelerometer, which measures, at least in part, the effects of gravity (e.g., as an acceleration component), such as acceleration along one or more predetermined directions. Additionally or alternatively, a measurement device 192 may be or include a gyroscope, which measures rotational positioning (e.g., as a rotation component).

A measurement device 192 in accordance with the present disclosure can be mounted on or within the remote user interface device 1000, as required to sense movement or position of remote user interface device 1000 relative to the washing machine appliance 10. Optionally, measurement device 192 may include at least one gyroscope or at least one accelerometer. The measurement device 192, for example, may be a printed circuit board which includes the gyroscope and accelerometer thereon.

The data of controller 188 can be stored locally (e.g., on controller 188) in one or more databases or may be split up so that the data is stored in multiple locations. In addition, or alternatively, the one or more database(s) can be connected to controller 188 through any suitable network(s), such as through a high bandwidth local area network (LAN) or wide area network (WAN). In this regard, for example, controller 188 may further include a communication module or interface that may be used to communicate with washing machine appliance 10, controller 100, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 4:
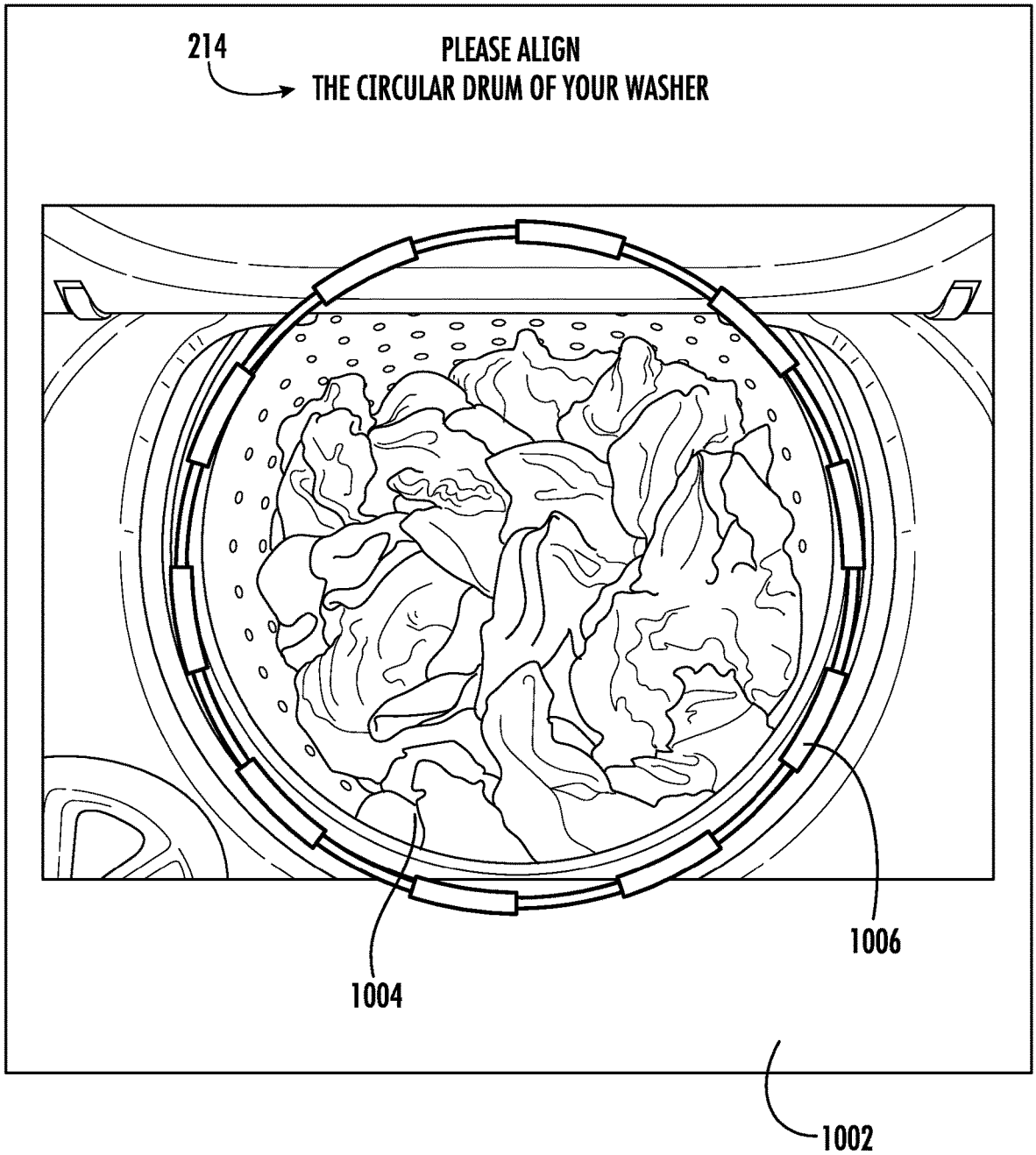
FIG. 4 provides an exemplary image which may be displayed on a remote user interface device according to one or more exemplary embodiments of the present disclosure.
Figure 5:
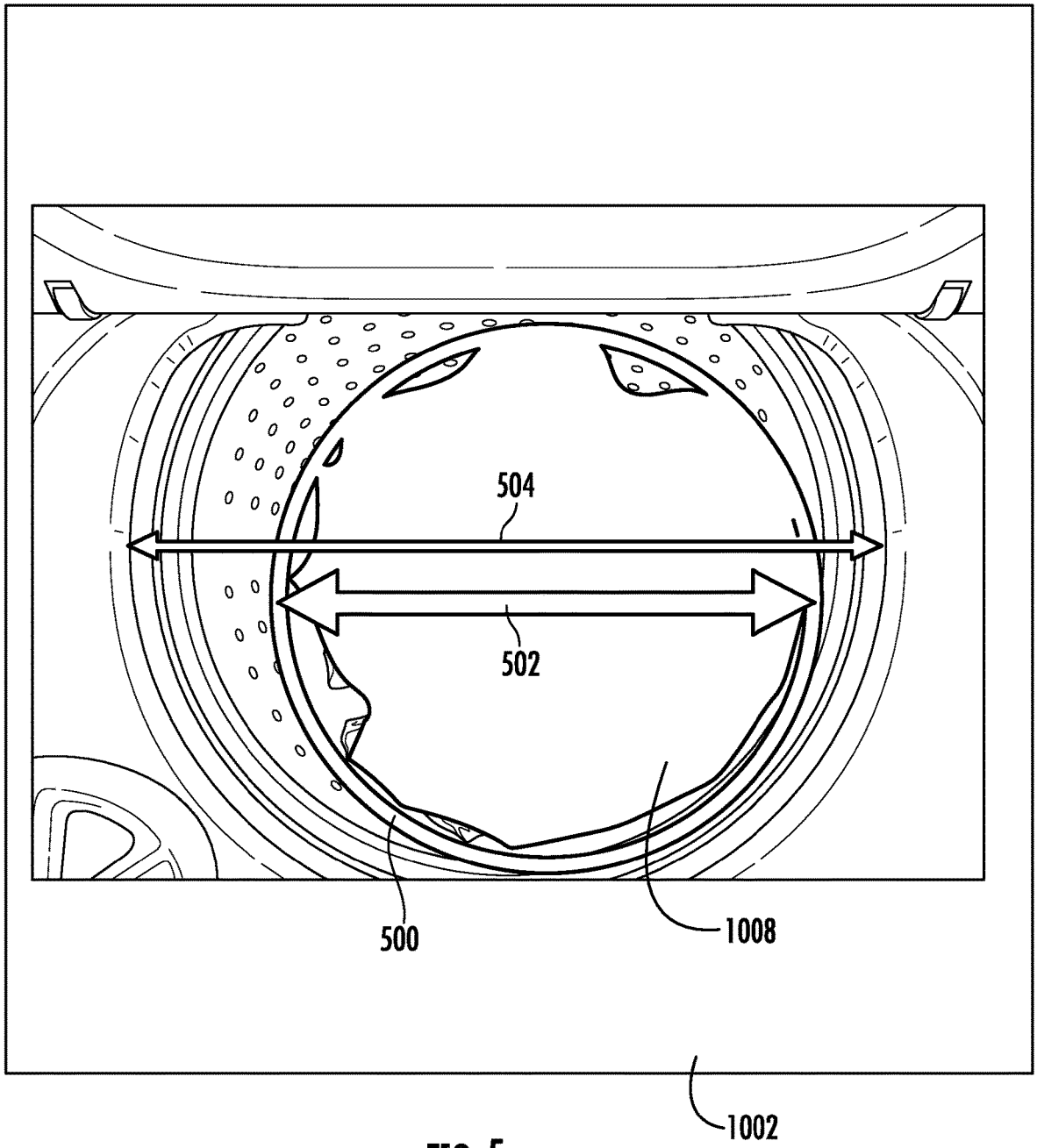
FIG. 5 provides an exemplary image analysis from which a load size may be estimated according to one or more exemplary embodiments of the present disclosure.
Figure 6:
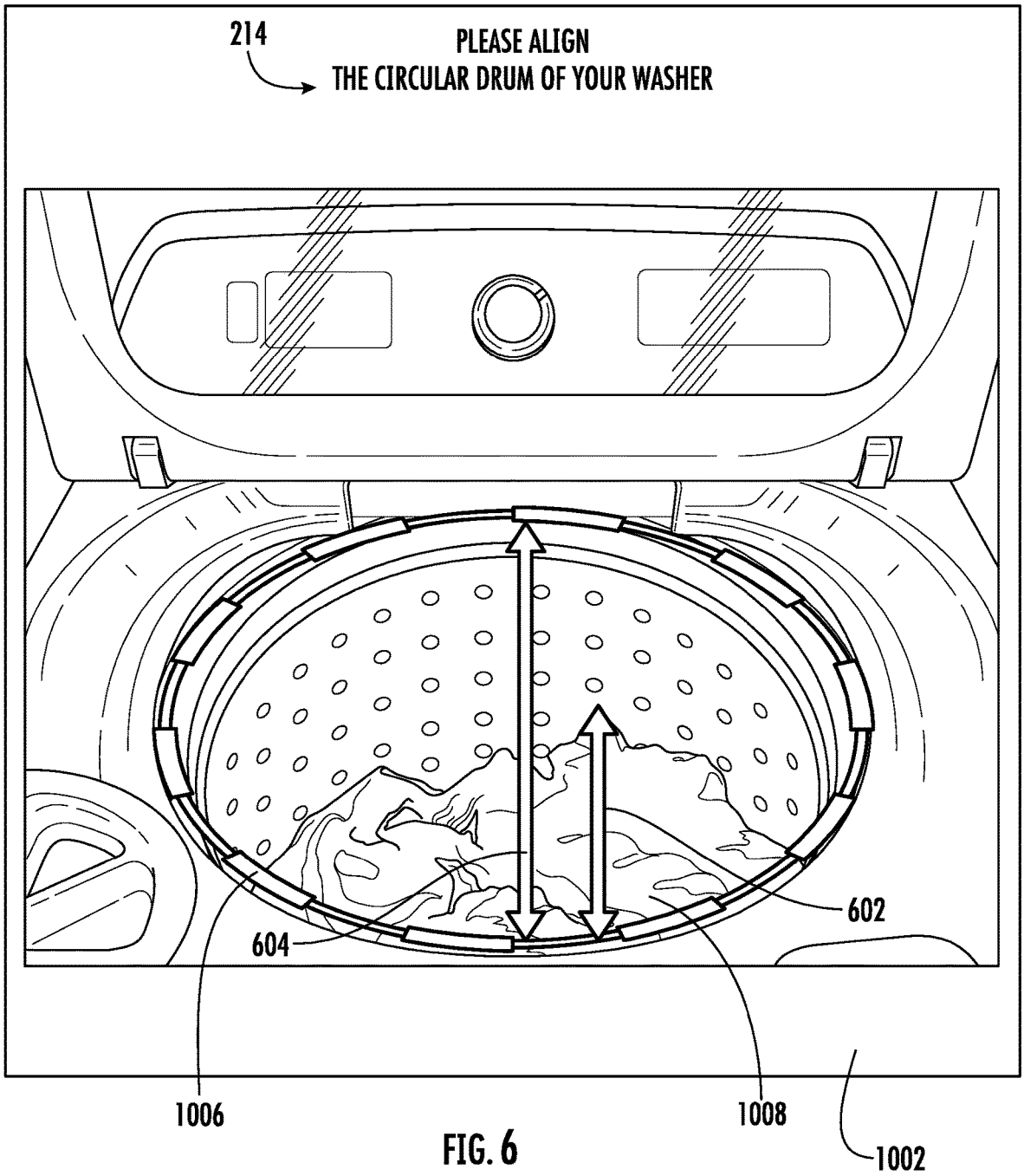
FIG. 6 provides another exemplary image which may be displayed on a remote user interface device according to one or more exemplary embodiments of the present disclosure.

Turning now to FIGS. 4 through 6 generally, FIGS. 4 through 6 illustrate exemplary images which may be provided on, e.g., displayed by, a display 1002 of the remote user interface device 1000. The display 1002 may generate, reproduce, and/or otherwise display a static image or a dynamic (e.g., animated or updated) image, which may be or include an image of a washing machine appliance, such as the exemplary washing machine appliance 50 or 10 described above, obtained by a camera of the remote user interface device. The image obtained by the camera may be, for example, a live image, e.g., that is captured and displayed in real time. In other embodiments, the image may be a still image or a series of still images, such as a chronological series of images, e.g., taken one or more seconds apart at generally regular intervals. For example, the image, e.g., live image or series of still images, may reflect addition or removal or rearrangement of articles within the wash chamber 73.

The image provided on the display 1002 of the remote user interface 1000 may be a composite or synthesized image, e.g., the image may include additional elements as well as the image obtained by the camera, such as a graphical overlay, a text overlay, or a combined overlay including both graphical elements and text elements. For example, such elements may include text elements 214, where the text elements 214 on the display 1002 may include explanatory text or instructions, e.g., pertaining to guidance for aligning the camera and/or framing the washing machine appliance, such as the fiducial reference, in the image. Also by way of example, the overlay may include user interface elements, e.g., interactive elements, such as a control or input, e.g., an area of the display which is configured to respond to an input such as a touch.

FIGS. 4 and 6 each represents an exemplary image, such as a live image, of the washing machine appliance which may be captured, e.g., by a camera of a remote user interface device, and which may be displayed, e.g., live or in real-time or near real-time, on a display such as the display 1002 of the remote user interface device 1000. Thus, it is to be understood that a "live image" as used herein is intended to include images which are continuously updated in real time or with some delay and which may be updated at least about once per second, e.g., which have a refresh rate of 1 Hz or greater. In particular, the exemplary images in FIGS. 4 and 6 each includes or depicts at least a portion of the washing machine appliance, such as the wash basket 70 (FIG. 2) and/or the opening which permits access into the wash basket 70. In some embodiments, the image may also include or depict a load of articles 1004 in the wash basket 70.

An image such as one of the images illustrated in FIGS. 4 and 6 may be a live image and may be used to guide a user in obtaining a still image of the washing machine appliance and the load of articles 1004 therein. In some embodiments, the resultant still image may be analyzed, e.g., to determine a load size and/or compare the load size to a recommended load size. For example, such guidance may include a fiducial marker or target, such as a reticle 1006, which is configured to align (on-screen, e.g., in the image provided on the display 1002) with the washing machine appliance, such as with a portion thereof, such as with an opening into the wash basket, e.g., the opening 142. The reticle 1006 may be a circle, e.g., as illustrated in FIG. 4, an ellipse, e.g., as illustrated in FIG. 6, or other suitable shape generally corresponding to one or more components (or portions or segments thereof) of the washing machine appliance with which the reticle is configured to align. Thus, for example, exemplary methods according to the present disclosure may include displaying, on a display of the remote user interface device, a reticle configured to align with the washing machine appliance, such as with the wash basket 70 and/or opening into the wash basket 70. In such embodiments, displaying the reticle may include overlaying the reticle on a live image of the washing machine appliance. Such embodiments may also include obtaining the image, e.g., still image, while the reticle is aligned with the wash basket in the live image on the display of the remote user interface device. Such alignment may serve to promote consistency and accuracy in image processing and image analysis performed on the resultant image, e.g., by ensuring that the image to be analyzed is captured at a known distance from the washing machine appliance and a known angle to the washing machine appliance, or within an acceptable tolerance, such as plus or minus ten percent or ten degrees, of the known distance and angle.

FIGS. 5 and 6 each represents an exemplary image including an overlay in addition to the image of the washing machine appliance, such as an image which may be displayed on the display 1002 of a remote user interface device. As illustrated in FIGS. 5 and 6, the overlay may include a mask 1008, e.g., which corresponds to or overlies (in the image on the display 1002) the load of articles 1004 (FIG. 4) in the wash basket. Such mask 1008 may be used in or generated by an image analysis process, which includes determining or identifying, such as via one or more region proposals, a region (e.g., within the wash chamber 73) occupied by the load of articles 1004. The image analysis process may be, e.g., an image segmentation process, e.g., including an image segmentation map of which the mask 1008 may be a part. For example, the region occupied by the load of articles 1004 may be used in determining a load size of the load of articles. The load size may be, for example, measured or estimated as a proportion, such as a percentage, of the volume of the wash chamber 73. The proportion may be, for example, a ratio or percentage of the region occupied by the load of articles compared to a region representing the entire wash chamber. Such load size may, in some exemplary embodiments, be displayed as a text element of the overlay.

The ratio or percentage of the region occupied by the load of articles compared to a region representing the entire wash chamber may be a ratio of circles, e.g., as illustrated in FIGS. 4 and 5, a ratio of ellipses, e.g., as illustrated in FIG. 6, or other suitable shapes for the respective areas or portions of the image(s).

Referring now specifically to FIG. 5, some embodiments may include analyzing at least one obtained image by determining a ratio of a diameter of an area occupied by the load of articles to a diameter of the wash basket. For example, as may be seen in FIG. 5, the area occupied by the load of articles may be fit within a circle 500, and the circle 500 may define a diameter 502. The diameter 502 of the area occupied by the load of articles may be compared to a diameter 504 of the washing machine appliance, such as the diameter 504 of the wash basket 70, e.g., at the top opening of the wash basket 70. The wash basket 70 may be generally cylindrical, e.g., may have a generally constant diameter, such that diameter 504 may be approximately the same at any point along the height or depth (e.g., vertical dimension) of the wash basket 70. The diameter 504 may instead be the diameter of the top opening in the cabinet through which the wash basket 70 is accessed. Thus, in such exemplary embodiments, the load size of the load of articles may be expressed as a ratio, e.g., percentage, such as based on the ratio of diameter 502 to diameter 504.

Referring now specifically to FIG. 6, in some embodiments, one or more images may be obtained while the camera, e.g., of the remote user interface device, is at an oblique angle to the wash basket 70, e.g., in contrast to FIGS. 4 and 5 which illustrate images obtained while the camera, such as a centerline of the field of view of the camera, is generally orthogonal to the wash basket, e.g., to the top opening of the wash basket. When the image is obtained, or images are obtained, at an oblique angle, e.g., such as the exemplary image illustrated in FIG. 6, the top opening of the wash basket 70 appears as an ellipse in such image(s). The particular angle from which the image(s) is/are obtained will determine the eccentricity of the ellipse which represents the top opening of the wash basket in such image(s). Accordingly, some embodiments may include calculating the eccentricity of such ellipse. The eccentricity (e) of the ellipse having a major radius (a) and a minor radius (b) may be calculated from the following formula:

$$e = \sqrt{1 - \frac{b^2}{a^2}}, \ (0 \le e \le 1)$$

The eccentricity of the ellipse may be used, for example, to generate an elliptical reticle 1006, e.g., as illustrated in FIG. 6. As may be seen in FIG. 6, the area occupied by the load of articles may define a height 602, and the height 602 may be generally parallel to the minor axis 604 of the ellipse, e.g., of the elliptical reticle 1006. The height 602 of the area occupied by the load of articles is the largest or longest dimension of the area occupied by the load of articles along a direction that is generally parallel to the minor axis 604. The height 602 of the area occupied by the load of articles may be aligned, e.g., colinear, with the minor axis 604, or may be offset from the minor axis 604, as illustrated in FIG. 6. For example, the load of articles may be asymmetrically distributed within the wash basket 10, such that the height 602 is off-center relative to the area occupied by the load of articles and thus may also be offset from the minor axis 604, e.g., as in FIG. 6. The height 602 of the area occupied by the load of articles may be compared to the minor axis 604 of the ellipse which represents the wash basket 70 in the image, such as the top opening of the wash basket 70, to determine the load size. Thus, in such exemplary embodiments, the load size of the load of articles may be expressed as a ratio, e.g., percentage, such as based on the ratio of height 602 to minor axis 604.

Now that the construction of exemplary washing machine appliances and the configuration of remote user interface device 1000 according to exemplary embodiments have been presented, exemplary methods (e.g., method 700) of operating a washing machine appliance will be described. Although the discussion below refers to the exemplary method 700 of operating washing machine appliance 50, one skilled in the art will appreciate that the exemplary method 700 is applicable to the operation of a variety of other washing machine appliances. In exemplary embodiments, the various method steps as disclosed herein may be performed (e.g., in whole or part) by controller 188, controller 100, or another, separate, dedicated controller.

Figure 7:
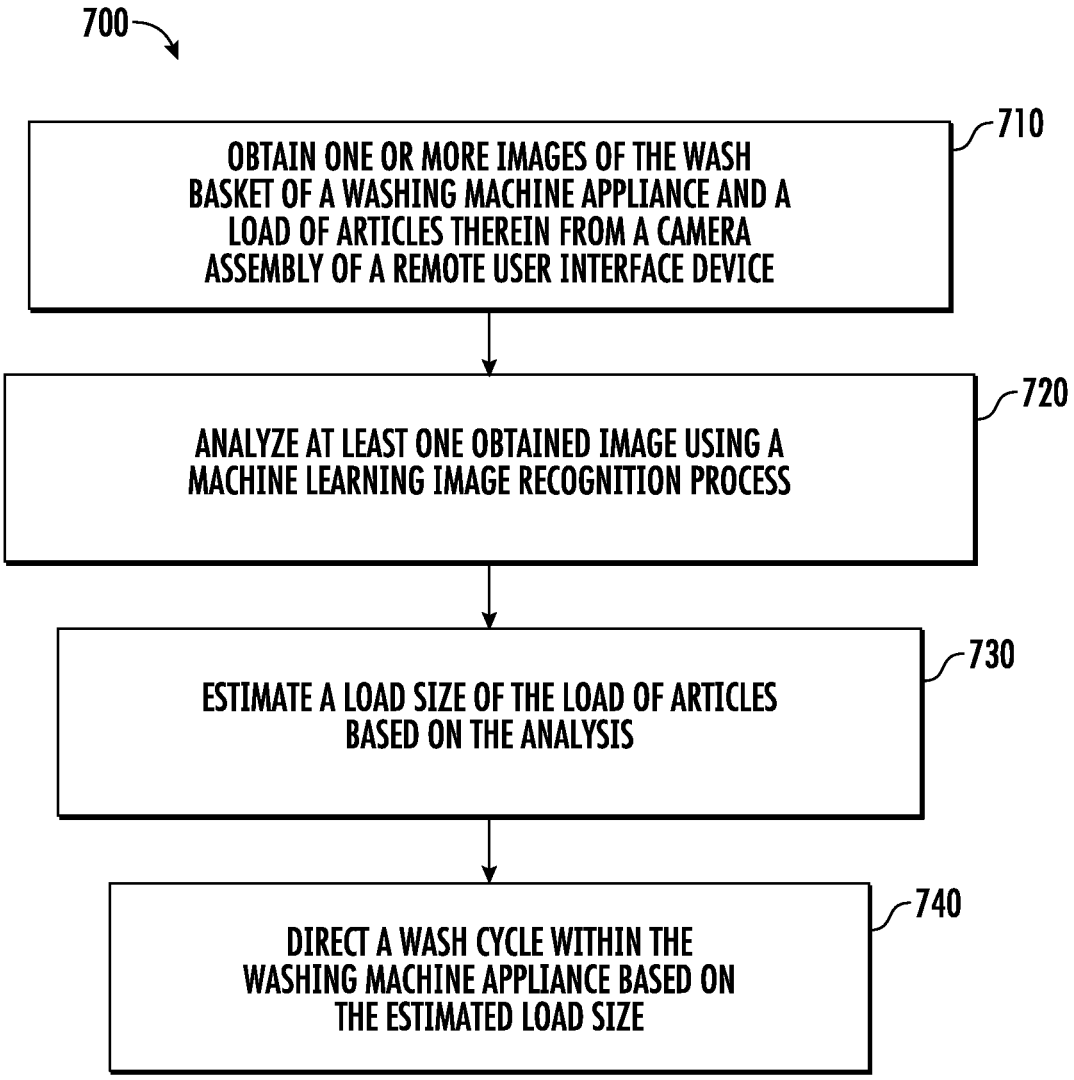
FIG. 7 provides a flow chart illustrating a method of operating a washing machine appliance according to exemplary embodiments of the present disclosure.

FIG. 7 depicts steps performed in a particular order for purpose of illustration and discussion. Those of ordinary skill in the art, using the disclosures provided herein, will understand that (except as otherwise indicated) the steps of the method 700 can be modified, adapted, rearranged, omitted, interchanged, or expanded in various ways without deviating from the scope of the present disclosure.

Advantageously, methods in accordance with the present disclosure may permit one or more attributes of a load of articles to be automatically and accurately determined. Additionally or alternatively, a user may be advantageously guided to ensure consistent and accurate images are gathered to, in turn, ensure accuracy of any further determinations.

Referring now to FIG. 7, at 710, the method 700 includes obtaining one or more images of the washing machine appliance from a camera assembly or module of an external device, e.g., a remote user interface device. In particular, the camera of the external device may be aimed at the washing machine appliance. Along with the cabinet or basket of the washing machine appliance, such images may include a load of articles, e.g., clothes, that are to be washed during a wash cycle of a washing machine appliance. In this regard, continuing the example from above, load of articles may be placed within wash chamber of the washing machine appliance prior to closing the door and implementing a wash cycle. Thus, the one or more images obtained at 710 in method 700 may include the wash basket and a load of articles therein.

It should be appreciated that obtaining the images may include obtaining more than one image, a series of frames, a video, or any other suitable visual representation of the load of articles using the camera assembly. Thus, 710 may include receiving a video signal from the camera assembly. Separate from or in addition to the video signal, the images obtained by the camera assembly may vary in number, frequency, angle, resolution, detail, etc. in order to improve the clarity of the load of articles. In addition, the obtained images may also be cropped in any suitable manner for improved focus on desired portions of the load of articles.

In some embodiments, the method 700 may include directing a real-time video feed of a washing machine appliance, e.g., a top portion or wash chamber of the same, at a camera assembly of a remote user interface device. Thus, method 700 may include obtaining more than one image, a series of frames, a video, or any other suitable visual representation of the washing machine appliance (and articles therein) from the camera assembly or module of a remote user interface device, i.e., external device, such as described above. In turn, method 700 may also include receiving a video signal from the camera assembly. Separate from or in addition to the video signal, the images obtained by the camera assembly may vary in number, frequency, angle, resolution, detail, etc. in order to improve the clarity of the load of articles. In addition, the obtained images may also be cropped in any suitable manner for improved focus on desired portions of the load of articles.

The obtained images are then presented or displayed as a real-time feed of the camera assembly at the remote user interface device (e.g., according to the received video signal). For instance, a constant or regularly refreshing set of live images from the camera assembly may be presented on the monitor or display of the remote user interface device. Thus, a user viewing the remote user interface device may be able to see the field of view being captured by the camera assembly (e.g., without having to repeatedly freeze the frame or provide any active input by a user on the remote user interface device).

In optional embodiments, the obtained images can be presented or displayed as a real-time feed of the camera assembly at the remote user interface device (such as according to the received video signal). For instance, a constant or regularly refreshing set of live images from the camera assembly may be presented on the monitor or screen of the remote user interface device. Thus, a user viewing the remote user interface device may be able to see the field of view being captured by the camera assembly, e.g., without having to repeatedly freeze the frame or provide any active input by a user on the remote user interface device.

The one or more images may be obtained using the camera assembly at any suitable time prior to initiating the wash cycle. For example, as best illustrated in FIGS. 4 and 6, these images may be obtained when the door is in the open position (e.g., such that the field of view of the camera can capture at least a portion of the wash chamber through the opening).

In certain embodiments, obtaining the images may permit or prompt determination that the door of the washing machine appliance is open. For instance, the method 700 may include determining the door is open based on one or more of the obtained images. Additionally or alternatively, determining the door is open may be based on a separate signal, e.g., received from the latch assembly, physically detecting a position of the door.

In some embodiments, the method 700 may include receiving a plurality of angle readings from the remote user interface device. Such angle readings may generally indicate the position of the remote user interface device, e.g., in multiple dimensions, such as three, relative to a fixed direction, axis, or point. For instance, the multiple readings may be detected for the remote user interface device relative to gravity. The angle readings may be received following or in tandem with 710. In some embodiments, the angle readings may be received from a measurement device of the remote user interface device, e.g., as described above. In particular, the measurement device may include an accelerometer configured to detect the tilt or angle of the remote user interface device, as would be understood.

In some embodiments, the method 700 may include determining a position (e.g., tilt or angular position) of the remote user interface device relative to the washing machine appliance. In particular, the determination of the position may be based on the angle readings described above. For instance, the angle readings may indicate how the remote user interface device (and thus camera assembly) is oriented in space. As the washing machine appliance is generally stationary, the position of the remote user interface device relative to the washing machine appliance may further be determined, as would be understood in light of the present disclosure.

Method 700 may further include detecting a fiducial reference on the washing machine appliance, e.g., on a top portion of the washing machine appliance within the one or more images. For instance, from the obtained images, the controller may identify the region corresponding to a predetermined portion of the washing machine appliance, which serves as the fiducial reference, such as an opening of the wash basket. Any suitable portion at the top of the washing machine appliance may serve as the fiducial marker. In some embodiments, the fiducial reference is the top opening (e.g., as defined by one or more of the cabinet, wash basket, and/or a gasket extending between the cabinet and the wash basket) permitting access to the wash chamber, such as may been, e.g., in FIGS. 4 and 6). As mentioned above, the memory devices of controller 188 may store data that can be retrieved, manipulated, created, or stored by the one or more processors or portions of controller 188. As an example, the data may include identifying information to identify or detect a fiducial reference on a top portion of the washing machine appliance 50 (e.g., using camera 178).

As is understood, recognizing or identifying such fiducial references or portions of the appliance, may be performed by one or more image processing techniques or algorithms (e.g., executed at the controller of the remote user interface device, remote server, or appliance). According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, grey-scale matching, histograms of receptive field responses, or another suitable routine (e.g., executed at the controller of the remote user interface device, remote server, or appliance based on one or more captured images from one or more cameras). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

In some embodiments, the method 700 may include comparing the detected fiducial reference to a two-dimensional reference shape in an obtained image of the one or more images. As would be understood, the two-dimensional geometry of a fiducial reference captured in an obtained image will vary depending on the angle of the camera when the image is obtained. The two-dimensional reference shape may correspond to the geometry of the fiducial reference in a set or predetermined camera angle (e.g., in which images to accurately analyze the load within the wash chamber may be obtained). As an example, the two-dimensional reference shape may be a circle (FIG. 4), such as may correspond to an intended geometry of the opening in a set angle of the camera, or may be an ellipse (FIG. 6). From the comparison, it may be determined if the fiducial reference matches the two-dimensional reference shape, e.g., the fiducial reference within the obtained image has dimensions that are within a set tolerance or range of the two-dimensional reference shape, such as 10%. For instance, the size or eccentricity of the fiducial reference within the obtained image may be calculated and compared to the size or eccentricity programmed for the two-dimensional reference shape.

In certain embodiments, the two-dimensional reference shape may be overlaid on the real-time feed. e.g., presented on the remote user interface device, such as the two-dimensional reference shape may be a reticle for guiding and aligning the obtained image with the fiducial reference, e.g., top opening of the washing machine appliance. Thus, as would be understood, a representation of the two-dimensional reference shape may be overlaid onto the real-time feed of the camera and appears as a fixed object in front of the digital representation, i.e., video, of the washing machine appliance on the monitor of the remote user interface device. The position of the two-dimensional reference shape that is displayed or overlaid may be constant, even as the camera angle and obtained images change. Thus, a user may be guided to move the camera such that the fiducial reference aligns to, e.g., behind or underneath, the overlaid two-dimensional reference shape. Separate from or in addition to the two-dimensional reference shape, the method 700 may provide for displaying movement guidance, e.g., in the form of pictorial or textual instructions, such as arrows or written messages, with the real-time feed, e.g., to help a user move the camera to align the two-dimensional reference shape with the fiducial reference.

In some embodiments, the method 700 may include determining a set camera angle for the camera assembly is met, e.g., based on the angle and/or position of the remote user interface device, as described above. As an example, the determined position of the remote user interface device may be determined to match the set camera angle, e.g., within a set tolerance or range, such as 10%. As an additional or alternative example, it may be determined that, within an obtained image, the fiducial reference matches or is aligned with the two-dimensional reference shape. Specifically, it may be determined that the fiducial reference in the obtained image has dimensions that correspond in size, curve, or location, e.g., within a set tolerance or range, such as 10%, to the dimensions of the two-dimensional reference shape.

In optional embodiments, a feedback signal is generated, e.g., at the remote user interface device, in response to determining the set camera angle is met. Such a feedback signal may include a feedback action, e.g., visual alert on the monitor, haptic movement at the remote appliance, audio tone, etc., corresponding to the set camera angle being met such that a user can know further movement of the camera is unnecessary.

In some embodiments, e.g., as illustrated at 720 in FIG. 7, the method 700 includes analyzing the obtained image using a machine learning image recognition process to estimate a load attribute of a load of articles within the washing machine appliance based on the analysis. In some embodiments, analyzing the at least one obtained image may include determining a ratio of a maximum height of an area occupied by the load of articles to a major axis of the wash basket. In additional embodiments, analyzing the at least one obtained image may include determining a ratio of a diameter of an area occupied by the load of articles to a diameter of the wash basket. As used herein, the term "load attribute" and the like is intended to refer to any qualitative or quantitative characteristic of articles within the wash chamber. For example, the load attribute may refer to a fabric type, a load color (such as white, light, dark, or mixed), or a load size (e.g., volume, mass, weight, etc.). In addition, it should be appreciated that the load attribute may be an approximation or best fit representation of a load of articles. For example, a controller may be programmed with thresholds for determining whether a load qualifies as a white load, such as greater than 70% whites, greater than 80% whites, greater than 90% whites, greater than 95% whites, etc. Thus, for example, method 700 may include estimating a load size of the load of articles based on the analysis, e.g., as indicated at 730 in FIG. 7.

In addition to providing approximations regarding primary load attributes such as type of fabric, color, and size, method 700 may, in some embodiments, further include extracting information regarding outliers relative to the average load attribute. For example, if a load is detected as being primarily white or light colors, an outlier may be a single dark garment within the load, such as a red sock within a load of whites. In addition, such embodiments may include extracting or identifying unwashable items, such as a belt, a wallet, or another item which was likely inadvertently added into the wash chamber. In sum, method 700 may be used for determining any suitable load attribute or other feature of a load of articles that may be useful in adjusting the operation of washing machine appliance to achieve a better outcome, such as improved efficiency, improved wash performance, etc.

As used herein, the terms image recognition, object detection, and similar terms may be used generally to refer to any suitable method of observation, analysis, image decomposition, feature extraction, image classification, etc. of one or more image or videos taken within a wash chamber of a washing machine appliance. It should be appreciated that any suitable image recognition software or process may be used to analyze images taken by the camera assembly and a controller may be programmed to perform such processes and take corrective action.

In certain embodiments, the image analysis may include utilizing artificial intelligence ("AI"), such as a machine learning image recognition process, a neural network classification module, any other suitable artificial intelligence (AI) technique, or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained images.

In this regard, the image recognition process may use any suitable artificial intelligence technique, for example, any suitable machine learning technique, or for example, any suitable deep learning technique. According to an exemplary embodiment, controller may implement a form of image recognition called region based convolutional neural network ("R-CNN") image recognition. Generally speaking, R-CNN may include taking an input image and extracting region proposals that include a potential object, such as an item of clothing (e.g., jeans, socks, etc.) or an undesirable article (e.g., a belt, a wallet, etc.). In this regard, a "region proposal" may be regions in an image that could belong to a particular object. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like. It should be appreciated that any other suitable image recognition process may be used while remaining within the scope of the present subject matter.

According to still other embodiments, the image recognition process may use any other suitable neural network process. For example, 450 may include using Mask R-CNN instead of a regular R-CNN architecture. In this regard, Mask R-CNN is based on Fast R-CNN which is slightly different than R-CNN. For example, R-CNN first applies CNN and then allocates it to zone recommendations on the covn5 property map instead of the initially split into zone recommendations. In addition, according to exemplary embodiments standard CNN may be used to analyze the image and estimate load size or main load fabric type of the load within the wash basket. In addition, a K-means algorithm may be used for dominant color analysis to find individual color of fabrics to serve with warnings.

According to exemplary embodiments the image recognition process may further include the implementation of Vision Transformer (ViT) techniques or models. In this regard, ViT is generally intended to refer to the use of a vision model based on the Transformer architecture originally designed and commonly used for natural language processing or other text-based tasks. For example, ViT represents an input image as a sequence of image patches and directly predicts class labels for the image. This process may be similar to the sequence of word embeddings used when applying the Transformer architecture to text. The ViT model and other image recognition models described herein may be trained using any suitable source of image data in any suitable quantity. Notably, ViT techniques have been demonstrated to outperform many state-of-the-art neural network or artificial intelligence image recognition processes.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with new images, may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models. According to exemplary embodiments, it should be appreciated that the machine learning models may include supervised or unsupervised models and methods. In this regard, for example, supervised machine learning methods (e.g., such as targeted machine learning) may help identify problems, anomalies, or other occurrences which have been identified and trained into the model. By contrast, unsupervised machine learning methods may be used to detect clusters of potential failures, similarities among data, event patterns, abnormal concentrations of a phenomenon, etc.

It should be appreciated that image processing and machine learning image recognition processes may be used together to facilitate improved image analysis, object detection, color detection, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

As shown at 740 in FIG. 7, the method 700 includes directing a wash cycle within the washing machine appliance based on the estimated load attribute, e.g., load size, such as from 730. Such direction may require adjusting one or more operating parameters of the washing machine appliance, e.g., as part of the wash cycle, which may then be initiated. Thus, 740 may include selecting an operating cycle parameter, adjusting a water or detergent fill amount such as a fill volume, adjusting an additive dispense dosage, or providing a user notification. As used herein, an "operating parameter" of the washing machine appliance is any cycle setting, operating time, component setting, spin speed, part configuration, or other operating characteristic that may affect the performance of the washing machine appliance. In turn, references to operating parameter adjustments or "adjusting at least one operating parameter" are intended to refer to control actions intended to improve system performance based on the load characteristics. For example, adjusting an operating parameter may include adjusting an agitation time or an agitation profile, adjusting a water level, limiting a spin speed of the wash basket, etc. Other operating parameter adjustments are possible and within the scope of the present subject matter.

For example, according to an exemplary embodiment, the mask R-CNN image recognition process may be used on one or more images obtained at 710 to determine that the load of articles is primarily delicate garments. As a result, it may further be determined that cool water should be used, e.g., water below a certain temperature, such as "cool" water is understood by those of ordinary skill in the laundry art in reference to the overall range of water temperatures which may be used in a wash operation, that the agitation profile should be gentle, and that the total wash time should be decreased. One or more of the corresponding controllers may automatically detect and implement such a wash cycle without requiring user input. By contrast, if a load of sheets or towels is detected, a large volume of hot water may be used with more detergent and an aggressive agitation profile. It should be appreciated that the exemplary load characteristics and the exemplary operating parameters described herein are only exemplary and not intended to limit the scope of the present subject matter in any manner.

In addition, adjusting the at least one operating parameter may include providing a user notification when a predetermined load attribute exists. For example, if the image analysis results in the detection of an unwashable item, the wash cycle may be restricted, e.g., stopped or otherwise prevented, and a user notification may be provided, e.g., via an indicator on the remote user interface device or the control panel of the appliance. Thus, for example, if a user inadvertently leaves their belt in a pair of pants thrown into the wash chamber, images obtained by the camera assembly may be used to detect the belt and instruct the user to remove the belt before the wash cycle commences. Similarly, if the image analysis detects a single light item in a load of dark clothes or a single dark item in a load of light clothes, a user may be notified of such condition or the wash cycle may be adjusted to reduce the temperature of water added during a wash cycle to reduce the likelihood of bleeding between the different color articles. According to another exemplary embodiment, the unwashable item may be a child, a pet, or any other item that is not intended for washing or drying. It should be appreciated that the items identified herein as "unwashable" are only exemplary and are not intended to limit the scope of the present subject matter.

In some embodiments, the start of the wash cycle may be contingent on one or more predetermined conditions. As an example, it may be required that a door shuts within a predetermined time period (such as less than one minute, such as a period less than or equal to 30 seconds, 15 seconds, or 5 seconds) following 710 or 740 (e.g., measured in response to 710 or 740). For instance, the method 700 may include determining the door of the washing machine appliance is closed within the predetermined time period, e.g., following 710. Such determination may be based on a signal from the latch assembly or a subsequently received image from the camera assembly. In turn, the wash cycle may be started in response to determining the door is closed within the predetermined time period. If the door is not determined to close within the predetermined time period, e.g., determination of the door being closed within the predetermined time period fails, a user may be required to manually input a start signal, e.g., by pressing a button, at the control panel of the washing machine appliance in order to prompt the wash cycle to start. Specifically, in the start of the wash cycle, whether automatic or manual, the washing machine appliance may start and further execute the selected wash cycle, as would be understood in light of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of determining a load size for a washing machine appliance, the washing machine appliance defining a vertical direction, a lateral direction, and a transverse direction, the vertical direction, the lateral direction, and the transverse direction being mutually perpendicular, the washing machine appliance comprising a cabinet, a wash tub mounted within the cabinet, and a wash basket, the wash basket defining a wash chamber, the wash basket rotatably mounted within the wash tub whereby the wash basket is rotatable about the vertical direction, the method comprising:

obtaining one or more images of the wash basket and a load of articles therein from a camera assembly of a remote user interface device;

analyzing at least one obtained image using a machine learning image recognition process, wherein analyzing the at least one obtained image comprises determining a ratio of a diameter of an area occupied by the load of articles to a diameter of the wash basket;

estimating the load size of the load of articles based on the analysis; and directing a wash cycle within the washing machine appliance based on the estimated load size.

2. The method of claim 1, further comprising estimating an additional load attribute based on the analysis, wherein the additional load attribute comprises at least one of a fabric type or a load color.

3. The method of claim 1, further comprising displaying, on a display of the remote user interface device, a reticle configured to align with the wash basket.

4. The method of claim 1, further comprising receiving a plurality of angle readings from the remote user interface device, determining a position of the remote user interface device relative to the washing machine appliance based on the plurality of angle readings, and determining a set camera angle for a camera assembly of the remote user interface device is met based on the determined position of the remote user interface device.

5. The method of claim 4, wherein the plurality of angle readings are detected by an accelerometer of the remote user interface device.

6. The method of claim 1, wherein directing the wash cycle within the washing machine appliance based on the estimated load size comprises setting a dispense dosage for the wash cycle based on the estimated load size.

7. The method of claim 1, wherein directing the wash cycle within the washing machine appliance based on the estimated load size comprises setting a fill volume for the wash cycle based on the estimated load size.

8. The method of claim 1, wherein obtaining one or more images comprises receiving a video signal from the camera assembly, and wherein the method further comprises:

presenting a real-time feed of the camera assembly at the remote user interface device according to the received video signal; and overlaying a two-dimensional reference shape over the real-time feed.

9. The method of claim 1, wherein the diameter of the area occupied by the load of articles is determined based on an image segmentation map.

10. A method of determining a load size for a washing machine appliance, the washing machine appliance defining a vertical direction, a lateral direction, and a transverse direction, the vertical direction, the lateral direction, and the transverse direction being mutually perpendicular, the washing machine appliance comprising a cabinet, a wash tub mounted within the cabinet, and a wash basket, the wash basket defining a wash chamber, the wash basket rotatably mounted within the wash tub whereby the wash basket is rotatable about the vertical direction, the method comprising:

obtaining one or more images of the wash basket and a load of articles therein from a camera assembly of a remote user interface device;

analyzing at least one obtained image using a machine learning image recognition process, wherein analyzing the at least one obtained image comprises determining a ratio of a maximum height of an area occupied by the load of articles to a minor axis of the wash basket;

estimating the load size of the load of articles based on the analysis; and directing a wash cycle within the washing machine appliance based on the estimated load size.

11. The method of claim 10, further comprising estimating an additional load attribute based on the analysis, wherein the additional load attribute comprises at least one of a fabric type or a load color.

12. The method of claim 10, further comprising displaying, on a display of the remote user interface device, a reticle configured to align with the wash basket.

13. The method of claim 10, further comprising determining a position of the remote user interface device relative to the washing machine appliance based on a plurality of angle readings, and determining a set camera angle for a camera assembly of the remote user interface device is met based on the determined position of the remote user interface device.

14. The method of claim 13, wherein the position of the remote user interface device is determined by analyzing a geometry of the wash basket in the at least one obtained image.

15. The method of claim 14, wherein the wash basket appears as an ellipse in the at least one obtained image, and wherein geometry of the wash basket is an eccentricity of the ellipse.

16. The method of claim 10, wherein directing the wash cycle within the washing machine appliance based on the estimated load size comprises setting a dispense dosage for the wash cycle based on the estimated load size.

17. The method of claim 10, wherein directing the wash cycle within the washing machine appliance based on the estimated load size comprises setting a fill volume for the wash cycle based on the estimated load size.

18. The method of claim 10, wherein obtaining one or more images comprises receiving a video signal from the camera assembly, and wherein the method further comprises:

presenting a real-time feed of the camera assembly at the remote user interface device according to the received video signal; and overlaying a two-dimensional reference shape over the real-time feed.

19. The method of claim 10, wherein the maximum height of the area occupied by the load of articles is determined based on an image segmentation map.

* * * * *